US005505126A

United States Patent [19]

Ohno et al.

[11] Patent Number: 5,505,126

[45] Date of Patent: Apr. 9, 1996

[54] DAMPENING ARRANGEMENT FOR A PRINTING PRESS

[75] Inventors: Kin-ichiro Ohno, Tokyo; Takashi Iijima, Yokosuka; Tamaki Ohkawara, Kawasaki; Daisuke Nakamura, Yokohama, all of Japan

[73] Assignee: Tokyo Kikai Seisakusho, Ltd., Tokyo, Japan

[21] Appl. No.: 508,717

[22] Filed: Jul. 28, 1995

[30] Foreign Application Priority Data

Apr. 3, 1995 [JP] Japan ..... 7-099435

[51] Int. Cl.[6] ..... B41F 7/24

[52] U.S. Cl. ..... 101/147; 101/366

[58] Field of Search ..... 101/132.5, 147, 101/148, 365, 366; 118/259

[56] References Cited

U.S. PATENT DOCUMENTS

| | | | |
|---|---|---|---|
| 3,924,531 | 12/1975 | Klingler | 101/147 |
| 4,064,801 | 12/1977 | Switall | 101/147 |
| 4,469,024 | 9/1984 | Schwartz et al. | 101/147 |
| 4,815,375 | 3/1989 | Switall et al. | 101/148 |

FOREIGN PATENT DOCUMENTS

| | | |
|---|---|---|
| 51-59511 | 5/1976 | Japan . |
| 1-110146 | 4/1989 | Japan . |
| 5-330009 | 12/1993 | Japan . |

*Primary Examiner*—Ren Yan

*Attorney, Agent, or Firm*—Armstrong, Westerman, Hattori, McLeland & Naughton

[57] ABSTRACT

A dampening arrangement for a printing press such as a lithographic press includes at least one solution receiving roller for receiving dampening solution and other rollers for conveying the dampening solution to a printing plate. The dampening arrangement is provided with a nozzle unit having a plurality of nozzles arranged substantially in parallel with the axis of the solution receiving roller and opposed to predetermined areas on the surface of the solution receiving roller, and a dampening solution supply source connected to the nozzle means for supplying the nozzles with a pressurized dampening solution. The distance between the nozzles and the surface of the solution receiving roller is automatically adjusted in accordance with the printing speed of the printing press. The printing press does not cause a printing defect due to excess supply of the dampening solution even when the printing press is operated at a high speed.

8 Claims, 6 Drawing Sheets

DAMPENING ARRANGEMENT FOR A PRINTING PRESS

BACKGROUND OF THE INVENTION

1. Field of the Invention

The present invention relates to a dampening arrangement for a printing press such as a lithographic press, and particularly to a dampening arrangement having nozzles for jetting dampening solution onto a roller.

2. Description of the Related Art

In lithography, image areas of a substantially smooth printing plate are treated to become lipophilic while non-image areas of the printing plate are treated to become hydrophilic. A dampening solution containing water as its main ingredient and an oil ink are applied to the printing surface of the printing plate, whereby only the image areas retain the oil ink for printing because of the mutual repellence between the dampening solution and the oil ink. Dampening arrangements for supplying dampening solution are divided into the following two types.

According to one type of dampening arrangement, a row of rollers is arranged from a dampening fountain to the printing surface. A rotating roller which is partially immersed in the dampening solution contained in the dampening fountain takes up the dampening solution onto its surface and transfers the dampening solution to a neighboring roller by contact therewith, whereby the dampening solution is transferred to the printing surface and applied thereto.

This type of dampening arrangement allows the dampening solution to be supplied to the surface of the roller in the form of a thin film spread evenly in an axial direction of the roller. However, it is difficult to change a supply rate of the dampening solution on the roller surface in each of the portions extending in the axial direction of the roller. Also, this type has the problem that ink is transferred from the printing surface into the dampening fountain through the row of continuously arranged rollers, leading to contamination of the dampening solution.

According to another type of dampening arrangement, in order to solve the aforesaid problem, a source of dampening solution is separated from the printing surface or from a row of rollers arranged to contact the printing surface. The dampening solution is jetted at the printing surface or at one of the rollers, whereby the supply rate of the dampening solution can be changed in each of portions extending in the axial direction of the roller. This type of arrangement includes a nozzle type dampening arrangement in which the dampening solution is jetted from nozzles, as disclosed in Japanese Patent Application Laid-open (kokai) Nos. 51-59511, 1-110146, and 5-330009.

Japanese Patent Application Laid-open No. 51-59511 discloses a dampening arrangement wherein a dampening solution is supplied to each of plural nozzles by a metering pump at a regulated rate and air is fed by a blower to cause a rapid flow of air so that a mist of the dampening solution is jetted from each of the nozzles. In the dampening arrangement, a drive motor of the measuring pump is controlled so as to run the measuring pump at a desired speed corresponding to the speed of a printing press.

Japanese Patent Application Laid-open No. 1-110146 discloses a dampening arrangement comprising a pump unit for supplying a dampening solution, nozzles for jetting the dampening solution supplied by the pump unit, and a controller to control the jet of the dampening solution from the nozzles in accordance with the printing speed of the printing press.

The timing of jetting the dampening solution is determined, as a number of revolutions of the plate cylinder of the printing press, on the basis of a reference value which is previously set and stored, an adjustment value which is entered in accordance with a printing image corresponding to each nozzle, and a correction value which is previously set and stored for each of printing speeds of the printing press. The nozzles are opened for a predetermined period of time at the thus determined timing, thereby controlling the jet of the dampening solution. That is, the dampening solution is jetted by a predetermined amount each time the plate cylinder of the printing press rotates by the thus obtained number of revolutions.

A specific description is not given, but according to Japanese Patent Application Laid-open No. 1-110146, in addition to the aforesaid control, the jet of the dampening solution may be controlled by changing the time period for jetting the dampening solution, i.e., the time duration for opening nozzles, or the jetting pressure, and also the jet of the dampening solution may be controlled by changing the opening area of a shutter member located ahead of each nozzle.

Japanese Patent Application Laid-open No. 5-330009 discloses a dampening arrangement comprising speed detecting means for detecting the printing speed of a printing press, a memory which stores a supply rate of dampening solution for each combination of printing condition and printing speed of the printing press, jetting means which is connected to a source of dampening solution and an air source by piping and which has a plurality of nozzles to continuously jet a mist of dampening solution, by rapid flow of the air, to a printing plate or the surface of a roller in contact with the printing plate, and pressure control means which is provided in a pipe connecting the source of dampening solution and the jetting means and which controls the pressure of the dampening solution supplied to the jetting means on the basis of the supply rate of the dampening solution stored in the memory.

In the dampening arrangement, the supply rate of the dampening solution is set in accordance with printing conditions such as a printing speed, humidity and temperature, and the thus set supply rate is compared with a pressure in the pipe downstream of the pressure control means to maintain the dampening solution discharged on the downstream side of the pressure control means at a constant pressure, thereby controlling the discharge rate of the dampening solution. In addition, a needle valve is provided on the upstream side of each nozzle to finely adjust the supply rate of the dampening solution, thereby guaranteeing a constant supply rate of the dampening solution.

Usually, liquid jetted from a nozzle does not evenly distribute over an area which the jetted liquid reaches (hereinafter referred to as "distribution area"). In other words, the amount of the liquid decreases at the peripheral portion of the distribution area compared to the rest of the area.

Thus, in the aforesaid conventional nozzle type dampening arrangement, the distance between neighboring nozzles and the distance between the nozzles and a printing plate or a roller at which dampening solution is jetted are set such that the distribution areas of the dampening solution somewhat overlap each other in the widthwise direction of the printing plate or in the axial direction of the roller, whereby neighboring distribution areas compensate each other for thinner application of the dampening solution at a peripheral portion of each distribution area.

Although the reason is unknown, various printing tests using a nozzle type dampening arrangement have revealed that even when the supply rate of dampening solution is adjusted according to printing conditions, a printing defect caused by excess dampening solution occurs on the printing surface at portions corresponding to overlapped portions of neighboring distribution areas of the dampening solution as the printing speed increases.

SUMMARY OF THE INVENTION

It is an object of the present invention to solve the aforesaid problem.

Another object of the present invention is to provide an improved dampening arrangement for a printing press which does not cause a printing defect due to excess supply of dampening solution even when the printing press is operated at a high speed.

A dampening arrangement for a printing press according to the present invention includes roller means composed of at least one solution receiving roller and having a portion in contact with a printing plate, nozzle means having a plurality of nozzles arranged substantially in parallel with the axis of the solution receiving roller and opposed to predetermined areas on the surface of the solution receiving roller, dampening solution supply means connected to the nozzle means for supplying the nozzle means with a pressurized dampening solution, displacement means for displacing the nozzle means to change the distance between the nozzles and the surface of the solution receiving roller, speed signal output means for outputting a speed signal corresponding to the printing speed of the printing press, nozzle operation control means for controlling the nozzles in response to the speed signal output from the speed signal output means to establish a nozzle opening condition corresponding to the printing speed, and nozzle displacement control means for controlling the displacement means in response to the speed signal output from the speed signal output means to adjust the distance between the nozzles and the surface of the solution receiving roller in accordance with the printing speed.

In the dampening arrangement for a printing press according to the present invention, the dampening solution supply means transfers the pressurized dampening solution to the nozzle means, and the nozzle means jets the dampening solution at predetermined areas on the solution receiving roller.

When the printing press is operated, the speed signal output means outputs a speed signal corresponding to the printing speed thereof, and the nozzle operation control means controls the nozzle opening condition in response to the speed signal. As a result, the dampening solution is jetted under previously set conditions at the predetermined areas on the surface of the solution receiving roller.

Also, the displacement means is controlled by the nozzle displacement control means in response to the speed signal output from the speed signal output means, so that the nozzle means, i.e., the jetting ports of the nozzles are moved to a predetermined position relative to the surface of the solution receiving roller, which position corresponds to the printing speed. Thus, the size of each dampening solution distribution area on the surface of the solution receiving roller is adjusted.

Accordingly, a regulated amount of dampening solution is jetted from each nozzle and is distributed over a regulated distribution area on the surface of the solution receiving roller.

As the roller means is operated, the dampening solution distributed on the surface of the solution receiving roller is applied to the printing plate either directly or via other neighboring rollers.

Separately from the dampening solution, ink is supplied to the printing plate by an inking arrangement. Because of the mutual repellence between lipophilic image areas on the printing plate and the dampening solution retained in hydrophilic non-image areas, ink is retained only in the image areas. Ink retained in the image areas is transferred for printing onto a web via the blanket surface of a blanket cylinder.

As has been described above, in the dampening arrangement according to the present invention, the distance between the nozzles for jetting the dampening solution, and the solution receiving roller for receiving the dampening solution can be changed in accordance with the printing speed. Thus, in neighboring distribution areas of the dampening solution jetted from neighboring nozzles on the surface of the solution receiving roller, the size of the overlapping portion thereof in the axial direction of the solution receiving roller can be automatically changed in accordance with the printing speed.

Accordingly, the printing surface is free from a printing defect which would otherwise be caused by excess dampening solution at portions corresponding to overlapped portions of the distribution areas of the dampening solution as the printing speed increases.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A dampening arrangement for a printing press according to an embodiment of the present invention will now be described with reference to the accompanying drawings.

Figure 1:
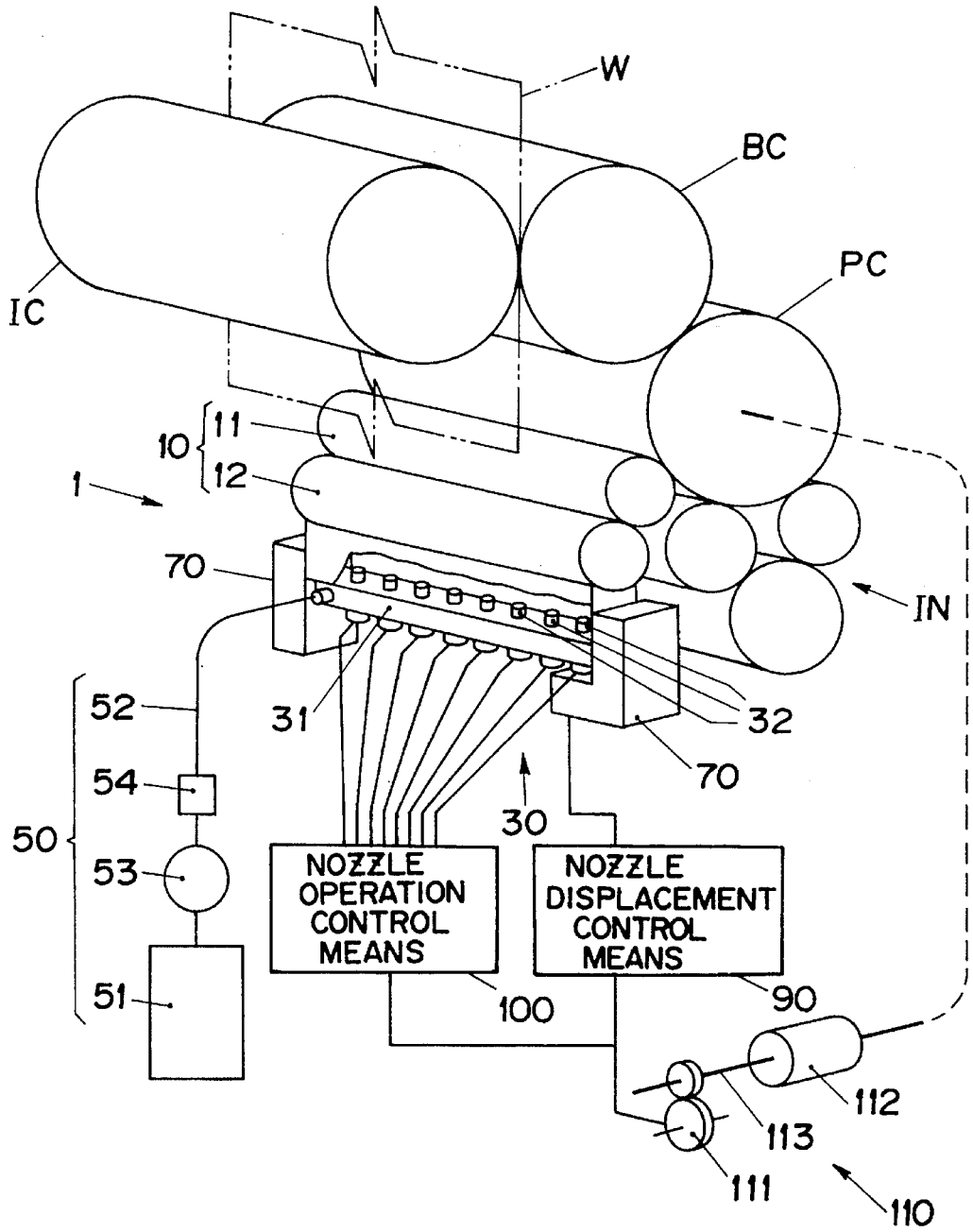
FIG. 1 is a perspective view showing the structure of a dampening arrangement for a printing press according to an embodiment of the present invention.

In a lithographic press equipped with a dampening arrangement 1 shown in FIG. 1, a printing plate (not shown), on which image areas are treated to be lipophilic while non-image areas are treated to be hydrophilic, is mounted on a printing cylinder PC. A proper amount of ink is supplied to the printing surface of the printing plate by an inking arrangement IN. In FIG. 1, an upstream portion of the inking arrangement is omitted, and only sides of the rollers thereof are shown. Also, a proper amount of dampening solution is supplied to the printing surface of the printing plate by the dampening arrangement 1.

By utilizing the mutually contradictory properties between the image areas and non-image areas on the printing surface and the mutually repellent properties between the dampening solution containing water as a main component and oil ink, ink is only applied to the image areas, and thus a printing image is printed on a web W running between a blanket cylinder BC and an impression cylinder IC via the surface of a blanket (not shown) mounted on the blanket cylinder BC.

The dampening arrangement 1 comprises roller means 10 having a portion in contact with the printing plate, nozzle means 30 for jetting the dampening solution to predetermined areas on the roller means 10, and dampening solution supply means 50 for supplying the dampening solution to the nozzle means 30.

The roller means 10 is composed of a downstream roller 11 and an upstream roller 12 arranged in parallel with each other. The downstream roller 11 rotates in contact with the printing plate. The upstream roller 12 rotates in contact with the downstream roller 11 and serves as a solution receiving roller to receive the dampening solution jetted from the nozzle means 30.

The illustrated roller means 10 is composed of two rollers, namely the downstream roller 11 and the upstream roller 12, but the downstream roller 11 may be omitted to adopt the construction in which the upstream roller 12 contacts the printing plate. Also, rider roller(s) (not shown) and intermediate roller(s) (not shown) may be added. Furthermore, the structure may be modified such that the dampening solution is received by the outer surfaces of a plurality of rollers at locations near the portion where neighboring rollers mutually contact. That is, the number of solution receiving rollers is not limited to one.

The nozzle means 30 is composed of a pipe member 31 arranged substantially in parallel with the axis of the upstream roller 12 and a plurality of nozzles 32, 32, etc., (eight nozzles are provided in the nozzle means shown in FIG. 1) which are mounted on the pipe member 31 with substantially equal spacing. Both longitudinal ends of the nozzle means 30 are attached, as described later, to frames F, F via displacement means 70 (see FIGS. 3 and 4). As described later, the pipe member 31 is supplied with pressurized dampening solution by the dampening solution supply means 50 connected thereto.

The nozzles 32, 32, etc., are arranged on the pipe member 31 such that they are directed to the surface of the upstream roller 12. Each nozzle 32 has a jetting port for jetting the dampening solution toward the surface of the upstream roller 12 such that the dampening solution elliptically spreads. Each nozzle 32 also has an inlet port for introducing the dampening solution from the pipe member 31. The nozzles 32 are oriented so that on the surface of the upstream roller 12, the major axes of elliptic distribution areas 32*a*, 32*a*, etc., of the dampening solution will become oblique with respect to the axis of the upstream roller 12 and substantially in parallel with each other.

Each nozzle 32 is provided with a solenoid valve mechanism (not shown) which operates under control of nozzle operation control means 100, described later, to open the jetting port of the nozzle 32 when a solenoid (not shown) is energized and close the jetting port by a spring (not shown) when the solenoid is deenergized.

The dampening solution supply means 50 comprises a dampening solution tank 51 to store the dampening solution, a pipe 52 which connects the dampening solution tank 51 and the pipe member 31, and a pump 53 provided in the pipe 52, and may further include a pressure regulator 54, as needed, which is located in the middle of the pipe 52 on the downstream side of the pump 53.

The pipe 52 or at least a portion thereof near a connection with the pipe member 31 is made of a flexible pipe material for example so that it can follow displacement of the nozzle means 30 effected by the displacement means 70, which will be described later.

Figure 4:
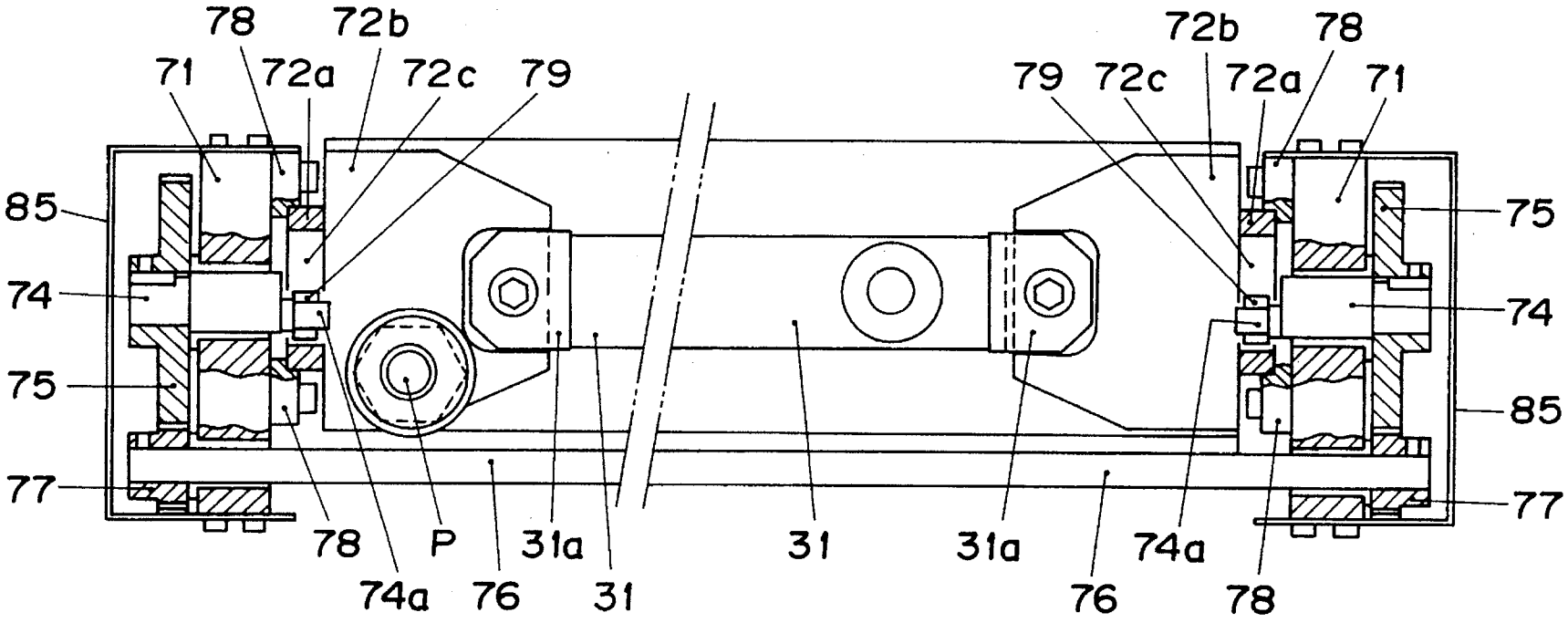
FIG. 4 is a partially sectioned bottom view of the nozzle means and nozzle displacement means shown in FIG. 3.
Figure 5:
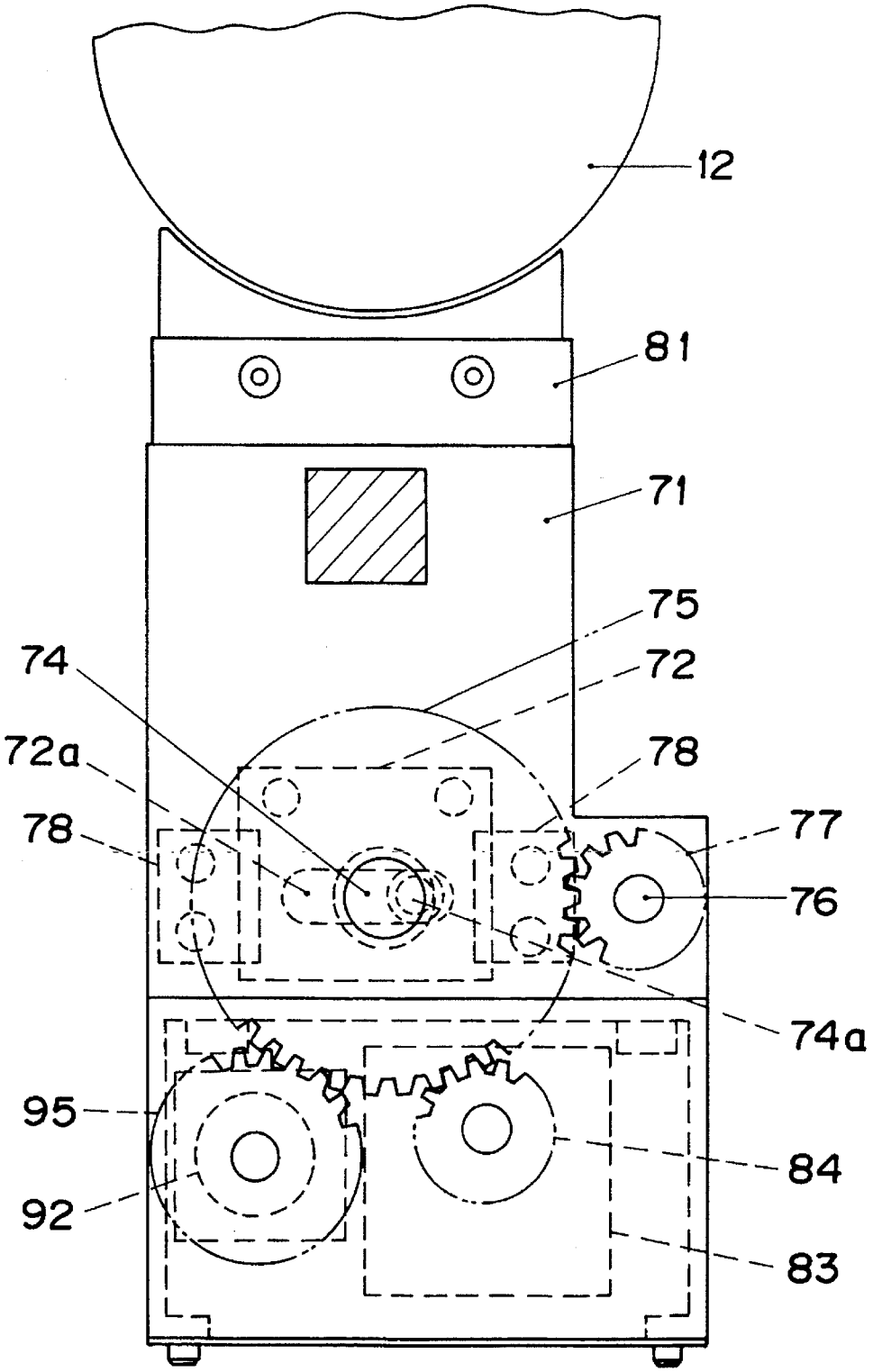
FIG. 5 is a partially sectioned side view of the nozzle means and nozzle displacement means shown in FIG. 3.
Figure 6:
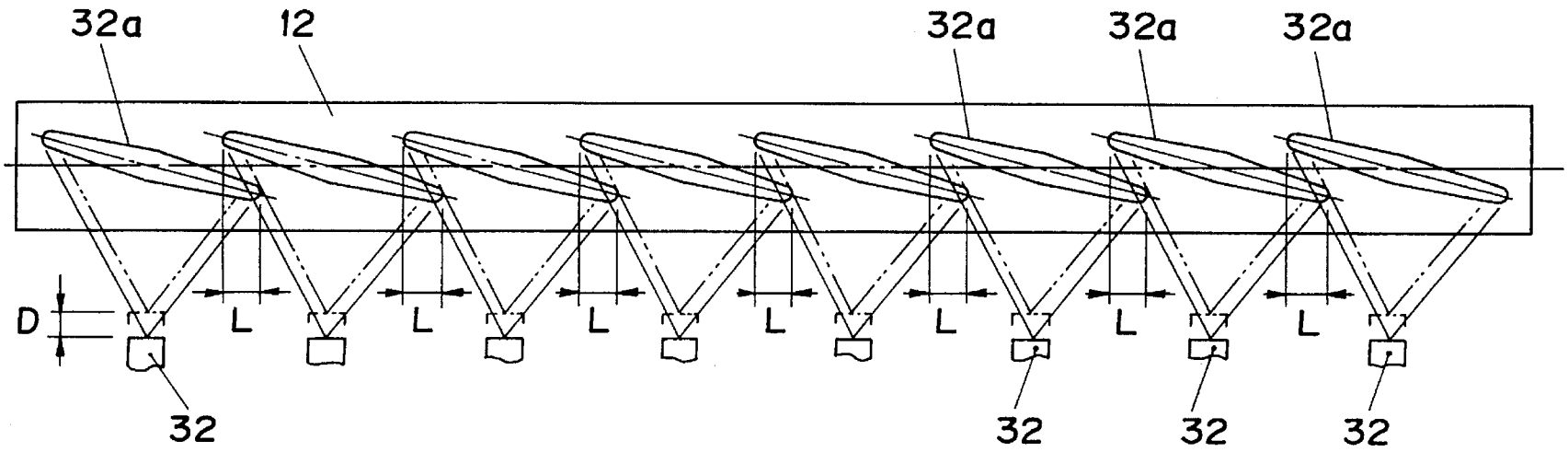
FIG. 6 is a view showing distribution areas on the surface of an upstream roller to which dampening solution is jetted from the nozzles of the dampening arrangement shown in FIG. 1.

The displacement means 70 which is disposed between both ends of the nozzle means 30 and the frames F, F will now be described with reference to FIGS. 3 to 5. First block members 71, 71 are attached to the frames F, F via respective brackets 73, 73 such that they are opposed to each other on an axis parallel to the axis of the upstream roller 12.

Gear shafts 74, 74 are rotatably supported on the lower portions of the first block members 71, 71 extending downward, the gear shafts 74, 74 being opposed to each other on a axis parallel to the axis of the upstream roller 12. Eccentric shaft portions 74*a*, 74*a* project inward from the inner end surfaces of the gear shafts 74, 74, the eccentric shaft portions 74*a*, 74*a* being opposed to each other at the same phase. Also, gears 75, 75 are mounted on the gear shafts 74, 74 at the outer end portions thereof. Both end portions of a through shaft 76 serving as a synchronous shaft are rotatably supported on the first block members 71, 71 at the lower portions thereof (see FIG. 4), the through shaft 76 being parallel to the axis of the opposed gear shafts 74, 74. Gears 77, 77 mounted on the through shaft 76 at both end portions thereof are engaged with respective gears 75, 75.

Figure 3:
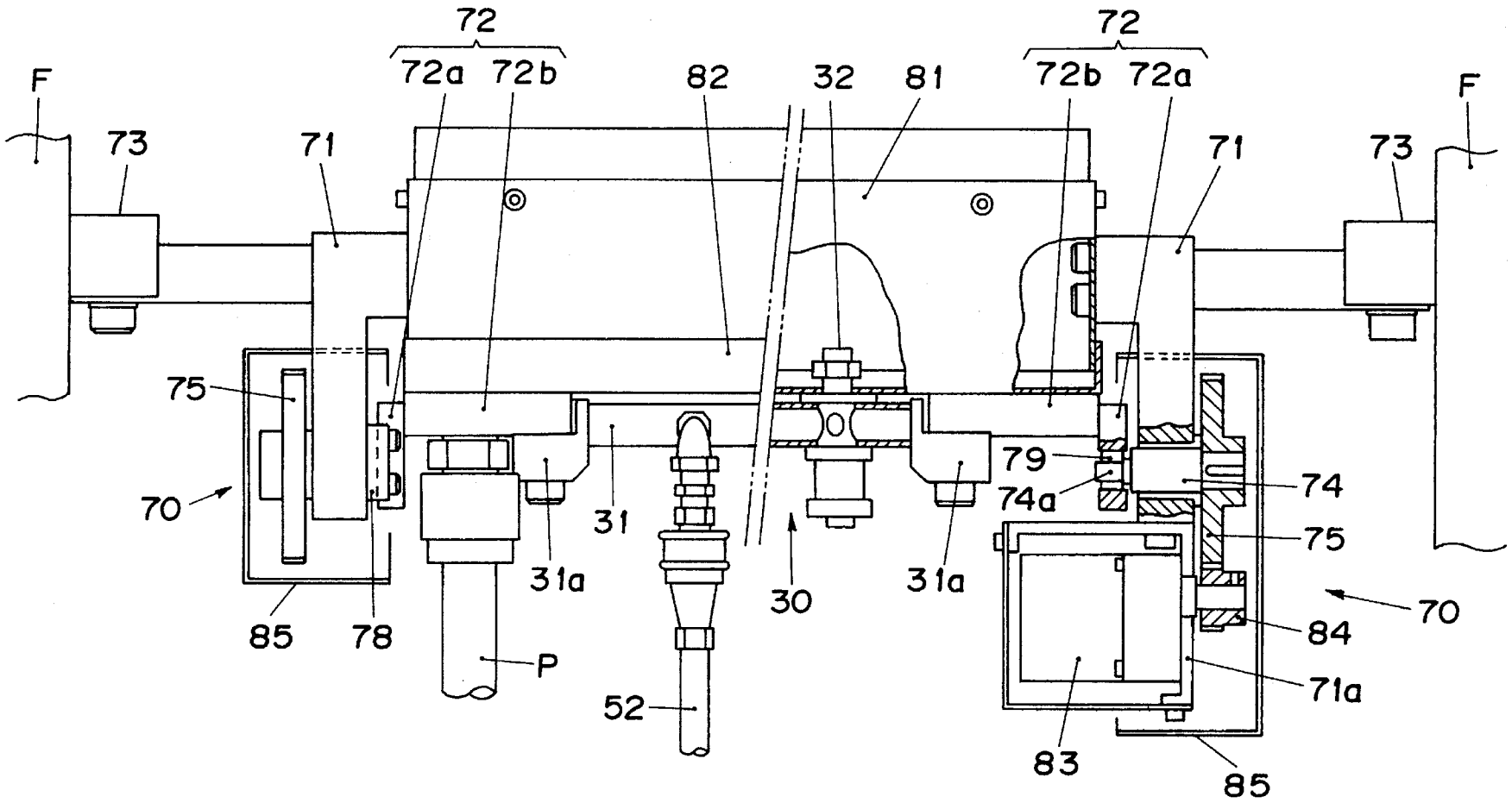
FIG. 3 is a partially sectioned front view of the nozzle means and nozzle displacement means of the dampening arrangement shown in FIG. 1.

A pair of guide members 78, 78 are mounted on the inner side surface of each first block member 71 at the lower portion thereof with spacing in the direction perpendicular to the sheet of FIG. 3 (i.e., in the top-and-bottom direction in FIG. 4) such that the gear shaft 74 is located between the guide members 78, 78. As shown in FIG. 3, an L-shaped second block member is held between a pair of guide members 78, 78 on the inner side surface of each first block member 71 at the lower portion thereof for movement in the top-and-bottom direction in FIG. 3 (i.e., in the direction perpendicular to the sheet of FIG. 4).

Also, a roller bearing 79 is attached to the eccentric shaft portion 74*a* of each gear shaft 74. That is, the inner ring of the roller bearing 79 is fitted to the eccentric shaft portion 74*a* of the gear shaft 74 while the outer ring of the roller bearing 79 is movably fitted into a slot 72*c* formed in a first leg 72*a* of each second block member 72. The slot 72*c* extends perpendicularly to the sheet of FIG. 3 (i.e., in the top-and-bottom direction in FIG. 4).

Blocking members 31*a* which block both ends of the pipe member 31 are attached to the tips of second legs 72*b*, 72*b* of the second block members 72, 72, which second legs 72*b*, 72*b* are opposed to each other on an axis parallel to the axis of the upstream roller 12. Thus, both ends of the pipe member 31 are supported by the second block members 72, 72, respectively, via respective blocking members 31*a*, 31*a*.

Both longitudinal end walls of the upper cover 81 having a rectangular cross section are fixed to the opposed faces of the first block members 71, 71. The upper cover 81 has a rectangular opening which extends in the axial direction of the upstream roller 12 and is directed upward. Arcuate cutaway portions are formed at the upper edges of both end walls, as shown in FIG. 5, and the lower portion of the upstream roller 12 is received by the arcuate cutaway portions. Longitudinal edges of the opening of the upper cover 81 are opposed to the surface of the upstream roller 12 with a very small gap therebetween.

A rectangular, shallow tray-like lower cover 82 also extends between the first block members 71, 71, and both end portions thereof are fixedly supported on the top surfaces of the legs 72*b*, 72*b* of the second block members 72, 72. The opening of the lower cover 82 fits to the bottom portion of the upper cover 81 such that the lower cover 82 can be displaced in the vertical direction.

A reversible motor 83 equipped with a speed reducer is mounted, via a mounting member 71*a*, on the bottom end surface of one of the first block members 71. In the present embodiment, the reversible motor 83 is attached to the right-hand first block member 71, as shown in FIG. 3. A gear 84 fixed to the output shaft of the reversible motor 83 is meshed with the gear 75 attached to the right-hand gear shaft 74.

A drain pipe P is connected to the second block member 72 opposite to the one to which the reversible motor 83 is attached, and communicates with a drain port formed in the bottom wall of the lower cover 82.

A gear mechanism (the gears 75, 77, and 84) provided on each of the first block members 71 and the reversible motor 83 are respectively covered with covers 85.

The displacement means 70 is operated by the reversible motor 83 under control of nozzle displacement control means 90, described later, to move the nozzle means 30, i.e., the nozzles 32, 32, etc., toward or away from the surface of the upstream roller 12.

Figure 2:
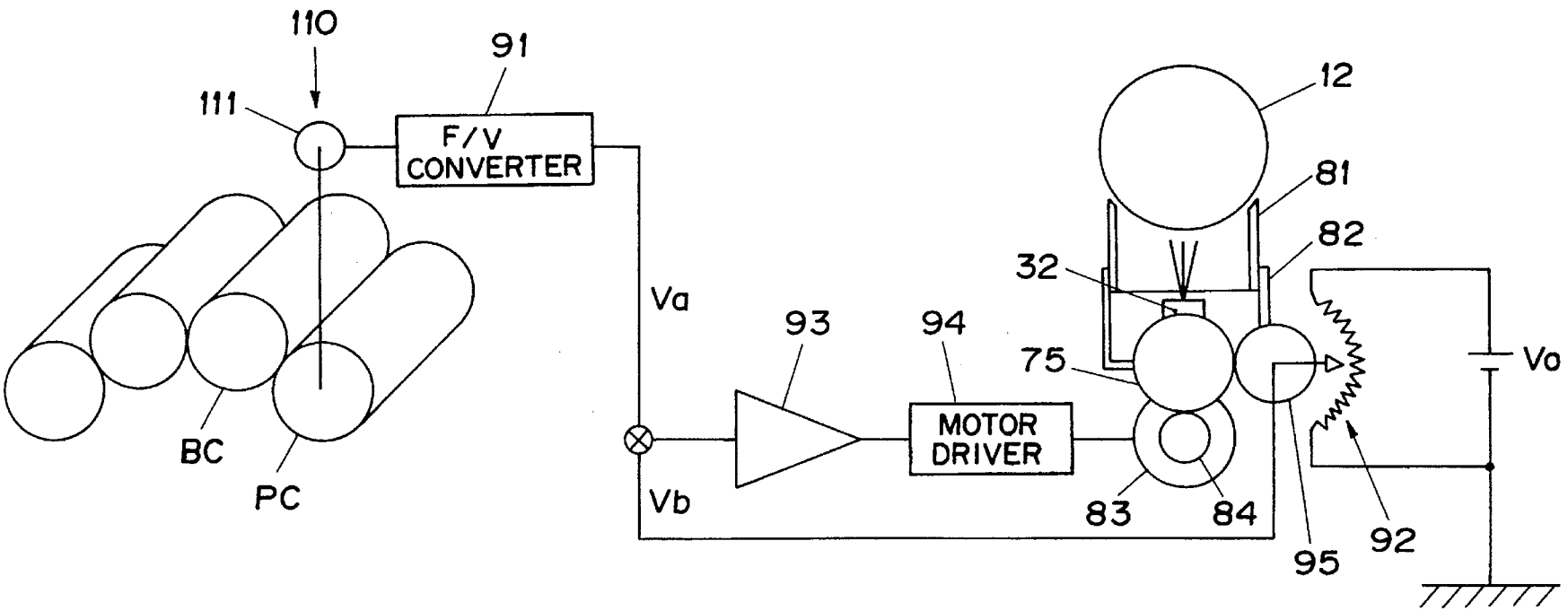
FIG. 2 is a view showing the structure of the nozzle displacement control means of the dampening arrangement shown in FIG. 1.

The nozzle displacement control means 90 and the nozzle operation control means 100 will now be described with reference to FIGS. 1 and 2.

The nozzle displacement control means 90 and the nozzle operation control means 100 are electrically interlocked with speed signal output means 110 which outputs a signal corresponding to the printing speed of a printing press. The speed signal output means 110 is mechanically coupled with the printing cylinder PC or a rotating portion which rotates synchronously with the printing cylinder PC, for example, a main drive shaft 113 rotated by a main drive source 112. The speed signal output means 110 includes a pulse output mechanism 111 such as a rotary encoder or the like which outputs pulse signals synchronously with the rotation of the printing cylinder PC.

In the nozzle displacement control means 90, an F/V converter 91 is connected to the pulse output mechanism 111 to receive the pulse signals so that a printing speed voltage $V_a$ corresponding to the rate of the received pulse signals is output from the F/V converter 91.

Also, a potentiometer 92 having an operating shaft is provided, and a predetermined voltage $V_0$ is applied thereto. A gear 95 is attached to the operating shaft and is meshed with the gear 75, which is meshed with the gear 84 mounted on the output shaft of the reversible motor 83.

Accordingly, an output voltage $V_b$ of the potentiometer 92 corresponds to the rotational phase of the gear 75, i.e., the position of the jetting ports of the nozzles 32 relative to the surface of the upstream roller 12. Thus, the output voltage $V_b$ changes in response to a change in the rotational phase of the gear 75, i.e., a displacement of the nozzle 32 effected, as described later, by the reversible motor 83.

A hysteresis amplifier 93 is arranged so that the difference between the printing speed voltage $V_a$ output from the F/V converter 91 and the voltage $V_b$ fed back from the potentiometer 92 is inputted thereto, and a signal corresponding to the input difference is output to a motor driver 94. The motor driver 94 is connected to the reversible motor 83 to rotate the reversible motor 83 in either direction in response to the output signal from the hysteresis amplifier 93.

The nozzle operation control means 100 receives pulse signals from the pulse output mechanism 111, and counts the pulse signals. Each time the counted number of the pulse signals reaches a predetermined value, the nozzle operation control means 100 outputs exciting current to the solenoids of the nozzles 32 and continues the supply of the exciting current for a predetermined period of time which corresponds to the number of pulse signals counted in a preset period of time, i.e., the printing speed. To effect this operation, the nozzle operation control means 100 is provided with a solenoid driver and a CPU, for example.

Also, the nozzle operation control means 100 independently controls the exciting current supplied to each of the solenoids provided for the nozzles 32, 32, etc.

The operation of the aforesaid dampening arrangement for a printing press will now be described.

The dampening solution stored in the dampening solution tank 51 is supplied through the pipe 52 to the pipe member 31 by the pump 53. Thus supplied dampening solution is maintained at a predetermined pressure by the pressure regulator 54.

The pressurized dampening solution supplied to the pipe member 31 is jetted from the nozzles 32, 32, etc., to predetermined areas on the surface of the upstream roller 12 of the roller means 10, which has a portion in contact with the printing plate, only when the solenoid valve mechanisms of the nozzles 32, 32, etc., are opened.

The excess portion of the dampening solution dropping from the surface of the upstream roller 12 is returned to the dampening solution tank 51 through the drain port formed in the bottom wall of the lower cover 82 and the drain pipe P.

When the printing press is operated, the rotating pulse output mechanism 111 outputs pulse signals in accordance with the rotation of the printing cylinder PC or the main drive shaft 113 rotated by the main drive source 112. The pulse signals are inputted to the nozzle operation control means 100 which counts inputted pulses. Each time the counted number of the pulse signals reaches a preset value, the nozzle operation control means 100 outputs excitation signal to the solenoids and continues the supply of the excitation signal for a preset period of time which corresponds to the number of pulse signals counted in a preset period of time, i.e., the printing speed.

In response to the excitation signal, the solenoid driver applies exciting current to the solenoids of the solenoid valve mechanisms to open the solenoid valves. As a result, the dampening solution is jetted under preset conditions to predetermined areas on the surface of the upstream roller 12.

The above-described preset value and the preset period of time used in the aforesaid control for opening the solenoid valves can be independently set for each of the nozzles 32, 32, etc., arranged on the pipe member 31. Thus, the conditions of jetting the dampening solution to the surface of the upstream roller 12 are varied for each of distribution areas on the roller surface according to the ratio and arrangement of printing images on the printing plate.

The dampening solution jetted from each nozzle 32 is distributed elliptically on the surface of the upstream roller 12 because of the shape of the jetting port of the nozzle, and the major axes of elliptic distribution areas 32*a*, 32*a*, etc., of the dampening solution are arranged obliquely with respect to the axis of the upstream roller 12 and substantially in parallel with each other. Accordingly, portions of neighboring distribution areas 32*a*, 32*a*, etc., which overlap in the axial direction are prevented from interfering with each other. Also, disturbance in the supply of the dampening solution due to mutual interference such as collision of the dampening solution jetted from the neighboring nozzles 32, 32 and a loss due to a change in the direction of jetting of the dampening solution can be prevented.

When the dampening solution received on the upstream roller 12 passes through the contact portion between the upstream roller 12 and the downstream roller 11 as the roller means 10 rotates, it is evened out and at the same time transferred to the downstream roller 11. The dampening solution transferred onto the downstream roller 11 is applied to the printing plate.

Meanwhile, ink is applied to the printing plate by the inking arrangement IN. Because of the mutual repellence between the lipophilic image areas on the printing plate and the dampening solution retained in hydrophilic non-image areas, ink is retained only in the image areas. Ink retained in the image areas is transferred for printing onto the web W via the blanket surface of the blanket cylinder BC.

The nozzle means 30 is displaced by a predetermined displacement D to move the jetting ports of the nozzles 32, 32, etc., toward or away from the surface of the upstream roller 12. The size L of the overlapping portion in the axial direction of the upstream roller 12 can be adjusted, for example, in the following range:

$$(L_{max} - L_{min}) \leqq 20 \text{ mm},$$

wherein $L_{max}$ is a maximum overlapping length, and $L_{min}$ is a minimum overlapping length.

When the reversible motor 83 rotates, the gear 84 mounted on the motor shaft rotates, and thus the gear 75 engaging the gear 84, i.e., the right-handed gear shaft 74 is rotated. At the same time, the left-handed gear shaft 74 is also rotated via the gear 77, the through shaft 76 and the gear 77. The rotation of the gear shafts 74 causes the eccentric shaft portions 74*a* of the gear shafts 74 to revolve around the axes of the gear shafts 74. The horizontal displacement component of revolution of each eccentric shaft portion 74*a* is absorbed by the corresponding slot 72*c*, and only a vertical displacement component is transmitted to the corresponding second block member 72. As a result, the second block members 72 which are movably held between the guide members 78, 78 are displaced in the vertical direction in FIG. 3 along the guide members 78, 78.

Accordingly, the lower cover 82 fixedly supported on the second block members 72, 72 is moved in the vertical direction, changing the size of the overlap with the upper cover 81. Also, the pipe member 31 is moved in the vertical direction via the blocking member 31*a*. As a result, the jetting port of each nozzle 32 is moved toward or away from the surface of the upstream roller 12.

The position of the jetting port of each nozzle 32 relative to the surface of the upstream roller 12 is adjusted by controlling the number of revolutions and rotational direction of the reversible motor 83. As the main drive shaft 113 is rotated by the main drive source, the pulse output mechanism 111 outputs pulse signals synchronously with the rotation of the printing cylinder PC. The pulse signals are inputted to the F/V converter 91 of the nozzle displacement control means 90.

The F/V converter 91 outputs a printing speed voltage $V_a$ corresponding to the rate of the input pulse signals, i.e., in accordance with the printing speed. On the other hand, the potentiometer 92 outputs a voltage $V_b$ in accordance with the position of the jetting ports of the nozzles 32 relative to the surface of the upstream roller 12, i.e., the rotational phase of the operating shaft.

A voltage signal indicative of the difference between the printing speed voltage $V_a$ output from the F/V converter 91 and the voltage $V_b$ fed back from the potentiometer 92 is amplified at the hysteresis amplifier 93 and then inputted to the motor driver 94. The motor driver 94 drives the reversible motor 83 in a proper rotational direction based on the sign and magnitude of the output voltage signal of the hysteresis amplifier 93.

Thus, the motor driver 94 instructs the reversible motor 83 to rotate in the proper direction until the output voltage $V_b$ from the potentiometer 92, which voltage changes in accordance with the displacement of the jetting ports of the nozzles 32 effected by the operation of the reversible motor 83, reaches the printing speed voltage $V_a$, i.e., until the difference between both voltages becomes zero. As a result, the jetting ports of the nozzles 32 are moved, relative to the surface of the upstream roller 12, to a predetermined position corresponding to the printing speed.

In order to set a standard distance between the surface of the upstream roller 12 and the jetting port of the nozzle 32, i.e., a standard position of the jetting ports of the nozzles 32 with respect to the surface of the upstream roller 12, the eccentric shaft portions 74*a*, i.e., the gear shafts 74 are temporarily fixed to a predetermined phase, and then any one or a combination of the following adjustments is made: adjustment of the mounting position of the bracket 73, through which the nozzle means 30 is mounted to the frame F, adjustment of the relative position between the brackets 73 and the second block members 72, and adjustment of the relative position between the first block members 71 and the pipe member 31 of the nozzle means 30. Also, the standard position of the jetting ports of the nozzles 32 can be set by adjusting the set voltage $V_0$ of the potentiometer 92.

Obviously, numerous modifications and variations of the present invention are possible in light of the above teachings. It is therefore to be understood that within the scope of the appended claims, the present invention may be practiced otherwise than as specifically described herein.

What is claimed is:

1. A dampening arrangement for a printing press comprising:

roller means including at least one solution receiving roller and having a portion in contact with a printing plate;

nozzle means having a plurality of nozzles arranged substantially in parallel with the axis of the solution receiving roller and opposed to predetermined areas on the surface of the solution receiving roller;

dampening solution supply means connected to said nozzle means for supplying said nozzle means with a pressurized dampening solution;

displacement means for displacing said nozzle means to change the distance between the nozzles and the surface of the solution receiving roller;

speed signal output means for outputting a speed signal corresponding to the printing speed of the printing press;

nozzle operation control means for controlling the nozzles in response to the speed signal output from said speed signal output means to establish a nozzle opening condition corresponding to the printing speed; and nozzle displacement control means for controlling said displacement means in response to the speed signal output from said speed signal output means to adjust the distance between the nozzles and the surface of the solution receiving roller in accordance with the printing speed.

2. A dampening arrangement for a printing press according to claim 1, wherein said nozzle means comprises:

a pipe member which extends in a direction parallel to the axis of the solution receiving roller and is supported by a pair of block members for linear movement toward and away from the solution receiving roller; and a plurality of nozzles each of which is fluidly connected to the pipe member and has an opening for jetting the dampening solution.

3. A dampening arrangement for a printing press according to claim 2, wherein said displacement means comprises:

a pair of shafts which are disposed on both sides of said pipe member in the longitudinal direction thereof and which are rotatably supported by the block members;

a synchronous drive mechanism for synchronously rotating the shafts; and a motion transforming mechanism for converting rotational movements of the shafts to linear movement of said pipe member.

4. A dampening arrangement for a printing press according to claim 3, wherein said synchronous drive mechanism comprises:

a motor having an output shaft;

a first gear train for transmitting rotation of the output shaft of said motor to one of said shafts;

a synchronous shaft arranged in parallel to the pipe member; and a second gear train for transmitting the rotation of the output shaft of said motor to the other of said shafts via said synchronous shaft.

5. A dampening arrangement for a printing press according to claim 3, wherein said motion transforming mechanism comprises:

an eccentric shaft portion provided on each of said shafts; and a pair of second block members attached to both ends of said pipe member and each having a slot extending in a direction perpendicular to the linear movement of said pipe member, said eccentric shaft portion being received by said slot for engagement therewith.

6. A dampening arrangement for a printing press according to claim 1, wherein said speed signal output means comprises a rotary encoder which is mechanically coupled with a printing cylinder of the printing press or a rotating portion which rotates synchronously with the printing cylinder to output pulse signals at a rate corresponding to the printing speed of the printing press.

7. A dampening arrangement for a printing press according to claim 6, wherein said nozzle displacement control means controls said displacement means in accordance with the pulse signals output from said rotary encoder.

8. A dampening arrangement for a printing press according to claim 7, wherein said nozzle displacement control means comprises:

an F/V converter for converting the pulse signals output from the rotary encoder to a signal representing the printing speed of the printing press;

a position sensor means for detecting the position of said nozzle means to output a signal representing the position of the nozzle means; and drive means for driving said displacement means based on the signal representing the printing speed and the signal representing the position of the nozzle means.

* * * * *